United States Patent [19]

Bednar

[11] Patent Number: 4,823,524

[45] Date of Patent: Apr. 25, 1989

[54] APPARATUS FOR AIDING PEOPLE IN WALKING UP AND DOWN STAIRS

[76] Inventor: Joseph A. Bednar, 123 Howard St., Hopelawn, N.J. 08861

[21] Appl. No.: 71,394

[22] Filed: Jul. 9, 1987

[51] Int. Cl.[4] ..... E04F 11/00

[52] U.S. Cl. ..... 52/182; 182/106

[58] Field of Search ..... 52/182; 256/59; 182/106

[56] References Cited

U.S. PATENT DOCUMENTS 616,515 12/1898 Williams .

3,804,374 4/1974 Thom ..... 256/59

FOREIGN PATENT DOCUMENTS 142247 7/1903 Fed. Rep. of Germany .

*Primary Examiner*—Carl D. Friedman

*Attorney, Agent, or Firm*—Michael B. Einschlag

[57] ABSTRACT

Apparatus for aiding a person in walking up andn down a staircase which has at least one railing running alongside. The apparatus includes a series of structures which are affixed to the at least one railing for supporting a person's hands and arms and, thereby, a portion of the person's weight.

11 Claims, 2 Drawing Sheets

APPARATUS FOR AIDING PEOPLE IN WALKING UP AND DOWN STAIRS

BACKGROUND OF THE INVENTION

1. Field of the Invention

The present invention relates to apparatus for aiding people in walking up and down stairs.

2. Description of the Prior Art

Many people, and especially the elderly, have various ailments which cause their legs and the joints in their legs to be weak. Such ailments of the joints and, more specifically, of the knee joints, typically occur as a result of a degenerative disease such as arthritis. As a result, such people often experience difficulty in supporting their own weight and, more particularly, in walking up and down stairs.

The difficulty such people experience in walking up and down stairs limits their mobility in public buildings as well as in their home. Consequently, a need exists in the art for an apparatus which would aid the infirm in walking up and down stairs. In addition, there is a need for such an apparatus which would be inexpensive and would be useful in public buildings as well as in private homes. Further in addition, there is a need for such an apparatus which would not interfere with the normal activities of people who would not ordinarily need to use such an apparatus.

SUMMARY OF THE INVENTION

Embodiments of the present invention provide an apparatus for use in aiding people in walking up and down stairs which have at least one railing running alongside. Such embodiments comprise at least one means for supporting a person's weight on his hands and arms, the at least one means being affixed to the at least one railing.

In use, such embodiments provide an apparatus whereby a person can support a substantial portion of his weight by using his hands and arms. This reduces the weight bearing burden on the person's knees and allows the person to climb or descend stairs which would have been inaccessible otherwise. Further, additional embodiments utilize railings which are spaced at a sufficient distance from the stairs to permit the person to support a portion of his weight while his elbows are substantially locked. This enables the person to support a portion of his weight without the need to have substantial strength in his hands and/or arms.

First embodiments of the inventive apparatus comprise the use of wooden, metal, or plastic supports which may be affixed to an existing railing by, for example, screws. In addition, preferred first embodiments of the inventive apparatus comprise a multiplicity of supports which are affixed to railings disposed on opposite sides of a staircase. Such preferred embodiments include pairs of such supports —one support of a pair being affiexed to one railing and the other support of the pair being affixed to the other railing—wherein both supports of the pair are located at substantially the same distance from the top or the bottom of the staircase.

Second embodiments of the inventive apparatus comprise at least one railing having the above-described supports fabricated as an integral part thereof. In addition preferred second embodiments of the inventive apparatus comprise railings having a multiplicity of supports fabricated as an integral part thereof, which railings are disposed on opposite sides of a staircase.

Such preferred embodiments include pairs of such supports—one support of each pair being disposed on one railing and the other support of the pair being disposed on the other railing—wherein both supports of the pair are located at substantially the same distance from the top or the bottom of the staircase.

BRIEF DESCRIPTION OF THE DRAWING

The principles of the present invention may be clearly understood by considering the following detailed description in conjunction with the accompanying drawing, in which.

To facilitate understanding, identical reference numerals have been used to denote identical elements common to the figures.

DETAILED DESCRIPTION

Figure 1:
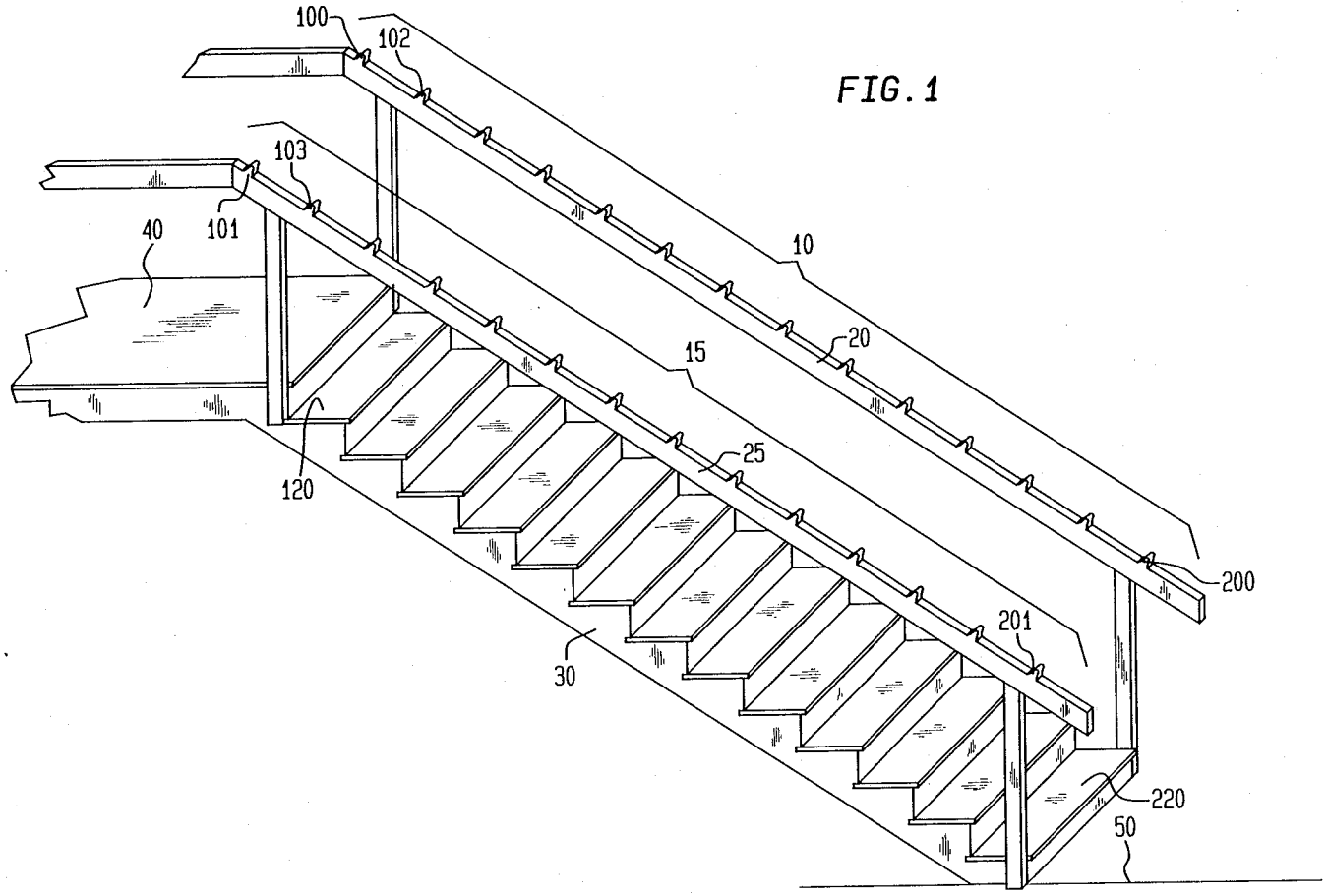
FIG. 1 shows, an pictorial form, a staircase having two railings, each railing having support means affixed thereto which are fabricated in accordance with an embodiment of the inventive apparatus.

FIG. 1 shows a preferred embodiment of the present invention. Support means 10 are affixed to the top surface of railing 20 and support means 15 are affixed to the top surface of railing 25. The top surface of railing 20 is disposed substantially parallel to staircase 30 and the top surface of railing 25 is disposed substantially parallel to staircase 30 and railing 20. Staircase 30 extends between landings 40 and 50 and railings 20 and 25 are disposed at substantially the same distance above staircase 30.

Different ones of support means 10 affixed to railing 20 and different ones of support means 15 affixed to railing 25 are spaced apart from each other at substantially the same distance along their respective railings. Further, different ones of support means 10 and different ones of support means 15 are disposed at particular locations along their respective railings such that pairs of supports, one from railing 20 and one from railing 25, are located at substantially the same distance along the railing from landing 40, for example, support means pair 100 and 101, pair 102 and 103, and so forth. Still further, as shown in FIG. 1, the top surfaces of the different ones of support means 10 and the top surfaces of the different ones of support means 15 protrude above the top surface of the adjacent portions of railings 20 and 25, respectively.

A person descends staircase 30 from landing 40 to landing 50 by placing one hand on one of support means 10, for example, support means 100, and by placing his other hand on one of support means 15, for example, support means 101. The person then steps forward and down toward step 120 of staircase 30. As the person moves forward, a portion of his weight is supported by his hands and arms which are supported, in turn, by support means 100 and 101. As a result, the person can lower himself onto step of staircase 30 without placing an undue burden upon his knees. Then, by repeating this, the person can descend staircase 30 by advantageously supporting a substantial portion of his weight with his hands and arms. Note that if the distance between railings 20 and 25 and staircase 30 is sufficiently large, a person can easily use the inventive apparatus to help lower himself from step to step without having to substantially bend his arms. This provides an extra advantage to those persons whose arms may not be strong enough to support a portion of their weight when their arms are bent. Further note, as will be explained in detail below, because supporting means 10 and 15 provide support for a person's hands without the need to provide a strong gripping action, a person can easily descend a staircase even if he has lost a substantial amount of strength in his hands and/or arms.

A person ascends staircase 30 from landing 50 to landing 40 by placing one hand on one of support means 10, for example, support means 200, and the other hand on one of support means 15, for example, support means 201. The person then steps forward and up onto step 220 of staircase 30. As the person moves forward, a portion of his weight is supported by his hands and arms which are supported, in turn, by support means 200 and 201. Then, by repeating this, the person can ascend staircase 30 by advantageously supporting a substantial portion of his weight by his hands and arms.

Figure 2:
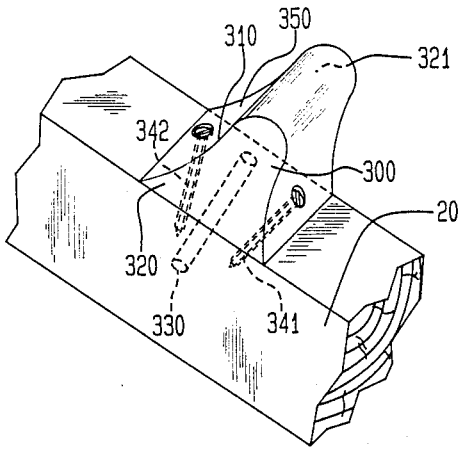
FIG. 2 shows, in pictorial form, a support means fabricated in accordance with the present invention

FIG. 2 shows a cross section of support means 300 which is fabricated in accordance with the present invention. Support means 300 is fabricated from wood and is affixed to railing 20 by means of dowel 330 and screws 340 and 341. Support means 300 has a bell shaped profile 310 and sides 320 and 321 which are substantially parallel planes. Note that top surface 350 of support means 300 protrudes above the top surfaces of the adjacent portions of railing 20.

In use, a person generally places the palm of his hand on surface 350 of support means 300. This allows him to support a portion of his weigh without having to strongly grip support means 300.

Figure 3:
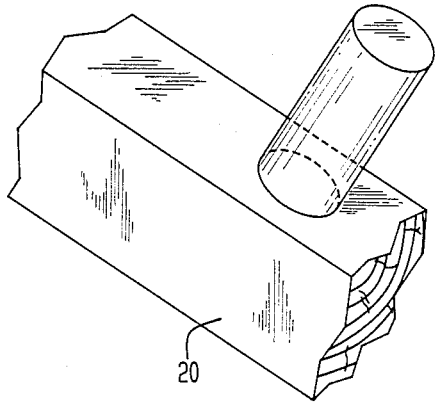
FIG. 3 shows, in pictorial form, a further support means fabricated in accordance with the present invention.
Figure 4:
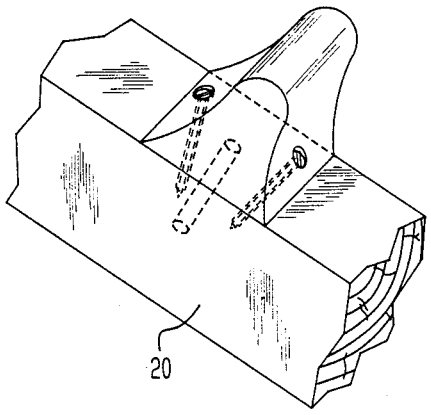
FIG. 4 shows, in pictorial form, a further manner of affixing a support means to a railing in accordance with the present invention.

It should be clear to those of ordinary skill in the art that the following particulars of support means 300 are not critical and may encompass a wide variety of different choices: (1) the shape of profile 310 may have a variety of different shapes such as a round shape, an elliptical shape, a straight-edged sawtooth shape and so forth; (2) sides 320 and 321 may have a variety of different shapes such as a rounded shape and so forth; (3) support means 300 may be fabricated out of a variety of different materials such as metal, wood, plastic, plastic laminate and so forth; and (4) support means 300 may be affixed to railing 20 by using a variety of different means such as dowels, screws, nails, glue and so forth. Indeed, support means 300 may even be a cylinder, as shown in FIG. 3, such as pipe which is affixed to railing 20 at, for example, a right angle. Still further, the support means may have protuberances extending therefrom which fit into slots or depressions in the railing to further provide secure attachment between the support and the railing, as shown in FIG. 4.

It should also be clear to those of ordinary skill in the art that the above-described railings and supports may be fabricated as one piece, the support means being an integral part of the railing.

It should be clear to those of ordinary skill in the art that embodiments of the present invention can be fabricated to fit staircase and railings of virtually every shape and size. It should also be clear to those of ordinary skill in the art that specific embodiments of the present invention can be fabricated to accommodate persons having any particular arm length. Further, embodiments of the present invention include embodiments wherein supports are only disposed along a single railing of staircase which has two railings. Still further, other embodiments of the present invention include embodiments wherein supports are disposed along a single railing of a staircase which only has one railing.

Although particular embodiments of the present invention have been shown and described herein, many varied embodiments incorporating the teachings of the present invention may be easily constructed by those skilled in the art.

I claim:

1. Apparatus for aiding a person in walking up and down a staircase, which staircase has at least one railing extending along the staircase and being disposed at a predetermined distance above the staircase, the top surface of the at least one railing extending substantially parallel to the staircase, the apparatus comprising:

a multiplicity of support means for supporting a person's hands, the multiplicity of support means being affixed to the top surface of the at least one railing at space apart locations and the top surface of each of the support means protruding above the top surface of the at least one railing.

2. The apparatus of claim 1 wherein at least one of the support means is comprised of wood and is affixed to the at least one railing with screws.

3. The apparatus of claim 2 wherein the at least one of the support means is further affixed to the at least one railing with glue.

4. The apparatus of claim 1 wherein at least one of the support means has a top surface which has a substantially bell-shaped profile.

5. The apparatus of claim 1 wherein at least one of the support means is comprised of plastic and is affixed to the at least one railing with screws.

6. The apparatus of claim 1 wherein at least one of the support means is affixed to the at least one railing with pegs extending into holes in the at least one railing.

7. The apparatus of claim 1 wherein at least one of the support means is substantially cylindrically shaped and is affixed to the at least one railing so that the axis of the cylinder is substantially perpendicular to the top surface of the at least one railing.

8. The apparatus of claim 1 wherein at least one of the support means has a top surface which has a substantially triangular-shaped profile.

9. The apparatus of claim 1 wherein:

the at least one railing comprises a pair of railings which extend along the staircase, the top surface of each railing of the pair extending substantially parallel to the staircase;

the multiplicity of support means comprises a predetermined number of pairs of support means, the first support means from each pair being affixed to the top surface of the first railing and the second support means from each pair being affixed to the top surface of the second railing; and the two support means in each pair being spaced at substantially the same distance from one end of their respective railings.

10. The apparatus of claim 1 wherein at least one of the support means has a protuberance extending from a bottom surface, which protuberance is disposed in a slot or depression in the at least one railing for affixing the support means to the at least one railing.

11. Apparatus for aiding a person in walking up and down a staircase which comprises:

at least one railing which extends along the staircase and is disposed at a predetermined distance above the staircase, the top surface of the at least one railing extending substantially parallel to the staircase; and a multiplicity of support means for supporting a person's hands, the multiplicity of support means being affixed to the top surface of the at least one railing at spaced apart locations and the top surface of each of the support means protruding above the top surface of the at least one railing.

* * * * *